US009332859B2

(12) United States Patent
Murray

(10) Patent No.: US 9,332,859 B2
(45) Date of Patent: May 10, 2016

(54) BASSINET APPARATUS

(71) Applicant: LeRahn Murray, Sanford, FL (US)

(72) Inventor: LeRahn Murray, Sanford, FL (US)

( * ) Notice: Subject to any disclaimer, the term of this patent is extended or adjusted under 35 U.S.C. 154(b) by 0 days.

(21) Appl. No.: 14/635,485

(22) Filed: Mar. 2, 2015

(65) Prior Publication Data

US 2015/0250329 A1 Sep. 10, 2015

Related U.S. Application Data

(60) Provisional application No. 61/947,729, filed on Mar. 4, 2014.

(51) Int. Cl.

| | |
|---|---|
| ***A47D 9/02*** | (2006.01) |
| ***A47G 9/02*** | (2006.01) |
| ***A47D 15/00*** | (2006.01) |
| ***A47G 9/10*** | (2006.01) |
| ***A47C 31/00*** | (2006.01) |

(52) U.S. Cl.

CPC ..... *A47D 9/02* (2013.01); *A47C 31/008* (2013.01); *A47D 15/005* (2013.01); *A47G 9/0215* (2013.01); *A47G 9/10* (2013.01)

(58) Field of Classification Search

CPC ..... A47D 9/02
USPC ..... 5/101, 107, 108, 109
See application file for complete search history.

(56) References Cited

U.S. PATENT DOCUMENTS

| | | | | |
|---|---|---|---|---|
| 3,078,479 | A * | 2/1963 | Grosse et al. | 5/104 |
| 5,547,425 | A * | 8/1996 | Krhs et al. | 472/110 |
| 6,012,189 | A * | 1/2000 | Dudley | 5/655 |
| 8,777,311 | B1 * | 7/2014 | Laurel, Jr. | 297/256.15 |
| 2013/0184088 | A1 * | 7/2013 | Haut | 472/119 |

* cited by examiner

*Primary Examiner* — Fredrick Conley
(74) *Attorney, Agent, or Firm* — Jason T. Daniel, Esq.; Daniel Law Offices, P.A.

(57) ABSTRACT

A bassinet apparatus includes a generally pedestal-shaped main body having a weighted bottom section, and a cradle that is positioned along the top end thereof. The cradle includes a bucket seat configuration having no corners or edges, and a centrally located motion unit imparts a front to back motion, and a side to side motion across in both a linear and angular manner.

18 Claims, 8 Drawing Sheets

BASSINET APPARATUS

CROSS-REFERENCE TO RELATED APPLICATIONS

This application claims the benefit of U.S. Application Ser. No. 61/947,729 filed on Mar. 4, 2014, the contents of which are incorporated herein by reference.

TECHNICAL FIELD

The present invention relates generally to infant sleeping devices, and more particularly to a bassinet apparatus.

BACKGROUND

Bassinets are articles of furniture in the nature of a small infant bed that traditionally includes a permanently affixed hood along one side. Because bassinets are typically used by infants, many parents expend great sums of money to ensure their bassinet is as attractive as possible. To this end, many parents will surround a bassinet with an outside covering which usually includes a skirt portion and a hood portion. Although these additions may increase the overall aesthetics of the device, the additional materials make it difficult for a parent to relocate or otherwise move the bassinet.

In addition to the above, traditional bassinets are designed to sway either back and forth, or from side to side, in order to lull the baby to sleep. To accomplish this goal, the bottom portion of these bassinet legs are curved, which allows the entire article (frame and all) to sway from side to side. Although this feature does allow the desired movement, there are there are numerous reported incidents of bassinets tipping over with a child inside. For this reason, other traditional bassinets are known which incorporate springs and other such hardware to move the bassinet. However, these devices are not favored by parents, as the components create a pinch point which can harm an unsuspecting toddler. Accordingly, the safety concerns of the rocking feature may, in many cases, outweigh the benefits of the bassinet entirely.

In addition to the above, there are many secondary items such as sound machines, vibrating pads, heating blankets, and the like, which are often utilized in conjunction with a bassinet. While useful in their own rights, the inclusion of these articles within the delicate confines of the bassinet often results in a plurality power cords jutting out and away from the bassinet body. These items can create a choking or electrocution risk to a sleeping infant. Moreover, the inclusion of these items can affect the center-of-gravity of the bassinet, thereby causing the bassinet to become top heavy and increasing the likelihood of causing the same to fall over, as described above.

Accordingly, there remains a need for a bassinet apparatus having a design that is capable of blending an ultra-safe modern form with the functionality of integrated components, and which does not suffer from the drawbacks of the above described articles.

SUMMARY OF THE INVENTION

The present invention is directed to a bassinet apparatus. One embodiment of the present invention can include a generally pedestal-shaped main body having a weighted bottom section, and a cradle that is positioned along the top end of the main body for receiving an infant. The cradle can include a bucket seat configuration having no corners or edges. The bassinet can also include a centrally located motion unit which can move the cradle in a front to back motion, and a side to side motion, both linearly and angularly.

Another embodiment of the present invention can include a remote operation unit having a camera, speaker and microphone which can allow a parent to remotely operate the bassinet and to provide two-way audio and visual communication with a child located in the bassinet.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
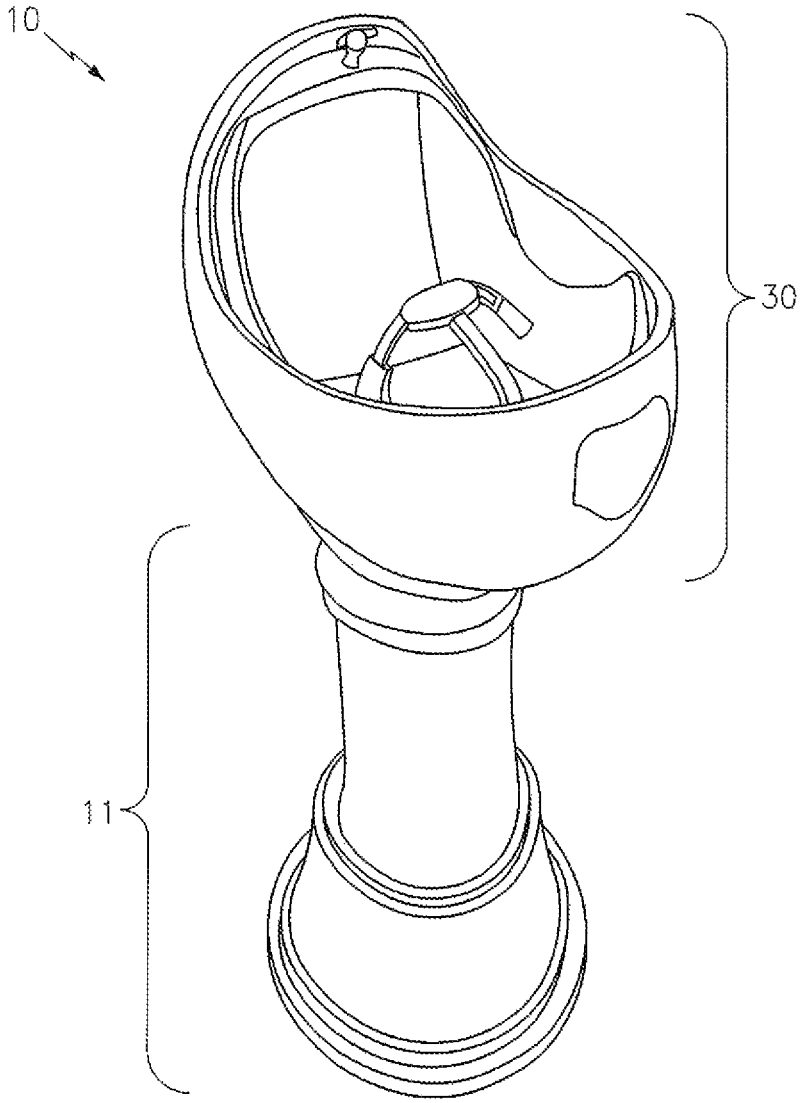
FIG. 1 is a perspective view of the bassinet apparatus that is useful for understanding the inventive concepts disclosed herein.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

Identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

As described herein, the terms "connector," "complementary connector" and derivatives thereof can include any number of different elements capable of repeatedly securing two items together in a nonpermanent manner. Several nonlimiting examples include opposing strips of hook and loop material (i.e. Velcro®), magnetic elements, tethers such as straps and ties, and compression fittings such bolt and nuts, snaps, and/or buttons, for example. Each illustrated connector can be permanently secured to the illustrated portion of the device via a permanent sealer such as glue, adhesive tape, or stitching, for example.

A bassinet apparatus is described below with respect to the figures. As will be known to those of skill in the art, the below descriptions and illustrations are to provide but one means for performing the inventive concepts and are not to be limiting in any way as to system components and/or method steps.

FIG. 1 illustrates one embodiment of a bassinet apparatus that is useful for understanding the inventive concepts disclosed herein. As shown, the bassinet 10 can include a main body 11, an infant cradle 30, and a remote operation unit 50.

Figure 2:
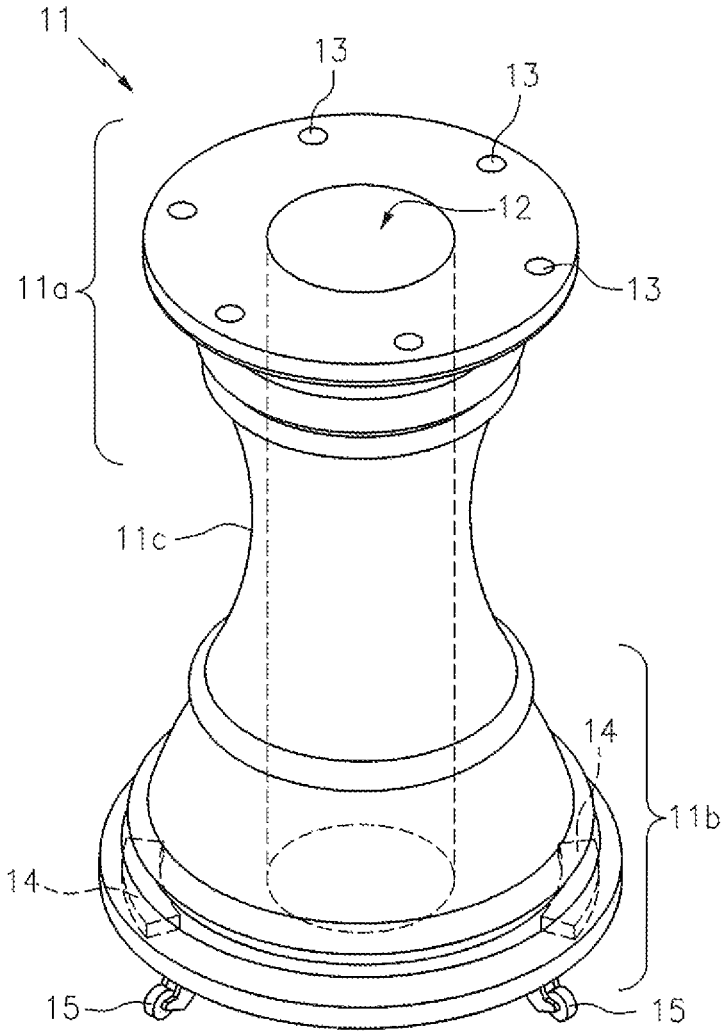
FIG. 2 is a perspective view of the main body of the bassinet apparatus, in accordance with one embodiment of the invention.

FIG. 2 illustrates one embodiment of the main body 11 with the cradle removed for ease of illustration. As shown the main body 11 can include an elongated, generally tubular member having a top end 11*a*, a bottom end 11*b*, and a middle section 11*c*. As shown, the top and bottom ends extend radially outward from the middle section to form a generally pedestal shape that is extremely stable. The main body can be constructed from any number of different materials suitable for providing a sturdy and tip-resistant platform. Several nonlimiting examples of suitable materials include: aluminum, metal, hardened plastic, injection molded plastic, and/or wood for example. Additionally, the outside portion of the main body can include any number of distinct colors, finishes and/or decorative shapes.

A centrally located hollow interior channel 12 can be disposed within the main body and can extend from the top end 11*a* to the bottom end 11*b*. Channel 12 can include a shape and dimension suitable for housing a power source and/or other components necessary to ensure smooth operation of the apparatus. The top end of the main frame 11*a* can also include a plurality of connectors 13 (preferably recessed threaded channels for receiving a bolt) suitable for receiving complementary connectors from the motion unit 40 of the cradle 30 (described below). Additionally, the main body can also include a plurality of internal weights 14 placed equidistantly along the bottom end 11*b*, in order to provide a bottom heavy device that will not tip over. Finally, the bottom end of the body 11*b* can include optional wheels 15 or sliders suitable for allowing the apparatus to be easily moved from one location to another via a sliding motion.

Figure 3:
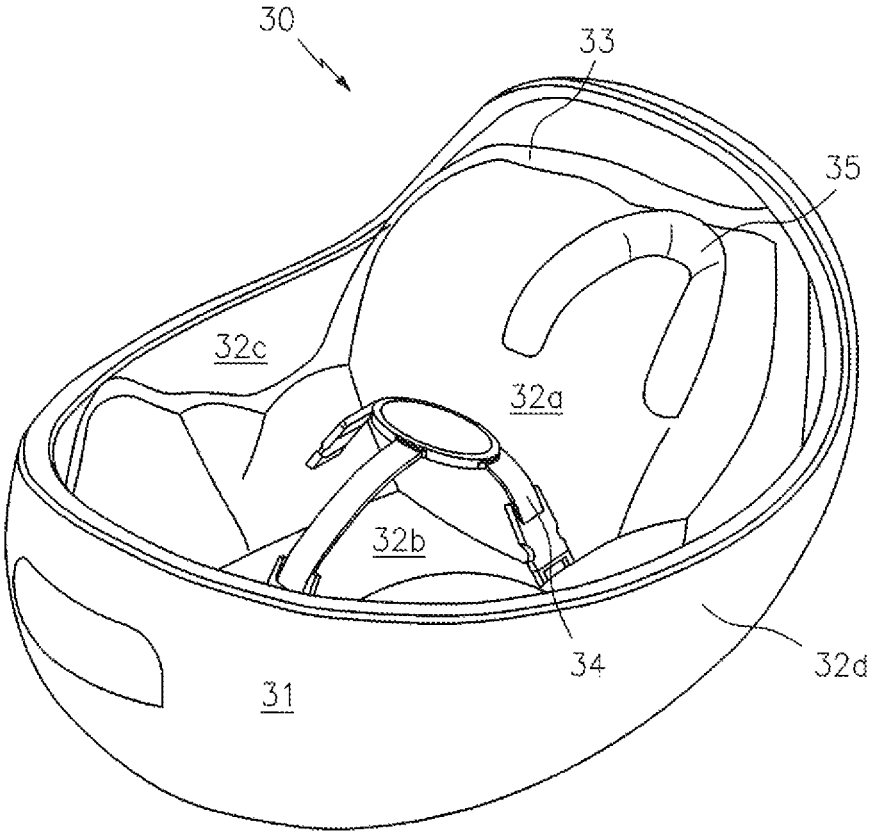
FIG. 3 is a perspective view of the cradle of the bassinet apparatus, in accordance with one embodiment of the invention.

FIG. 3 illustrates one embodiment of the cradle 30 that includes a main shell 31 having an interior space that is defined by a bucket seat into which a baby can be placed. The cradle shell 31 can preferably be constructed from hardened plastic or other lightweight but extremely sturdy material. As shown, the interior space can include a reclined back section 32*a*, a bottom section 32*b* and a pair of opposing side sections 32*c* and 32*d*.

As will be immediately noticeable to those of skill in the art, the design of the shell 31 forms a generally oval shape having a continuously rounded upper edge 31*a*. As such, the cradle has no corners or edge sections greater than 45 degrees, thereby providing two important safety features. First, the absence of corners greatly reduces the risk that the device can be become snagged on exterior objects, thereby reducing the likelihood of accidentally tipping over the device. Second, the interior portion of the cradle also has no corners or transitional areas having an angle greater than 45 degrees, thereby ensuring that a child cannot roll over or position themselves into a corner where suffocation can result.

Also positioned within the cradle 31 is a removable waterproof pad 33 which can function to provide comfort and warmth to the child. A three point harness 34 and a pillow style headrest 35 are also provided to ensure the comfort and safety of the child.

Now that the basic structural and safety elements have been disclosed, a description of additional functional components will be provided. Although described below with respect to particular components installed onto particular locations of the cradle and/or frame, the invention is not to be construed as limiting to the same, as the described components can be installed at other locations of the apparatus, and/or additional components can also be provided.

Figure 4:
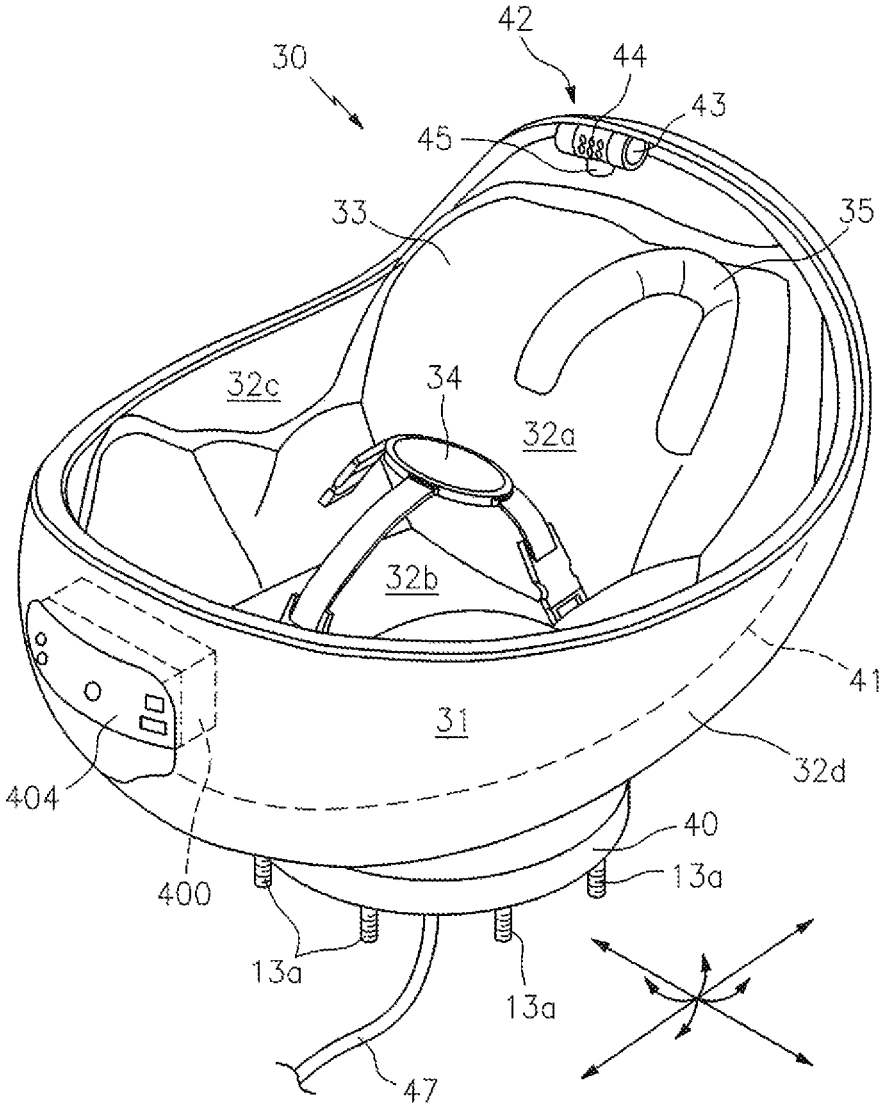
FIG. 4 is a perspective view of the cradle and motion unit of the bassinet apparatus, in accordance with one embodiment of the invention.

FIG. 4 illustrates one embodiment of the cradle 30 with a plurality of functional components installed thereon. As shown, a motion unit 40 can be secured to the bottom of the cradle body 31 and the top of the main body 11*a* via complementary connectors 13*a* (preferably bolts). In this regard, the motion unit will preferably be positioned at the center portion of the top end of the main body so as to maintain the center of gravity of the assembled bassinet apparatus.

As described herein, the motion unit 40 can function to provide controlled, gentle movement to the cradle 30. In one embodiment, the motion unit can include an electric motor system capable of providing four-way movement in a front to back direction, and a side to side direction. This movement can be both linear movement as well as angular movement, as shown by arrow A. Such a feature can enable the device to move the cradle via a gentle sliding motion or to rock/swing the cradle in virtually any direction. The electric motor system of the motion unit can also incorporate one or more linear actuators and/or a slide frame system (not illustrated) to impart the desired motion. In either instance, the motion unit 40 can be operated by a control unit and can further include an integrated oscillator/vibration element capable of imparting gentle and soothing vibrations into the cradle.

A heating pad 41 can be interposed between the cradle body and the cushion 33. Alternatively, the heating pad 41 can also be incorporated into the design of the cushion itself, in accordance with known manufacturing techniques. The heating pad can be operated by the control unit described below.

An integrated parent interface 42 can be provided along the cradle body. The interface can include a microphone 43, speaker 44 and camera 45 which can function to provide two-way communication between the child and parent. Each of these components can be operated via the control unit and can function to transmit video and audio signals between the bassinet and a remote operation unit (described below). The camera microphone and speaker functioning to allow a parent to watch, listen and speak to their child when the parent is not in the same room. By providing the camera microphone and speaker as an integrated component, that moves with the cradle, the camera never loses sight of the child.

Figure 4A:
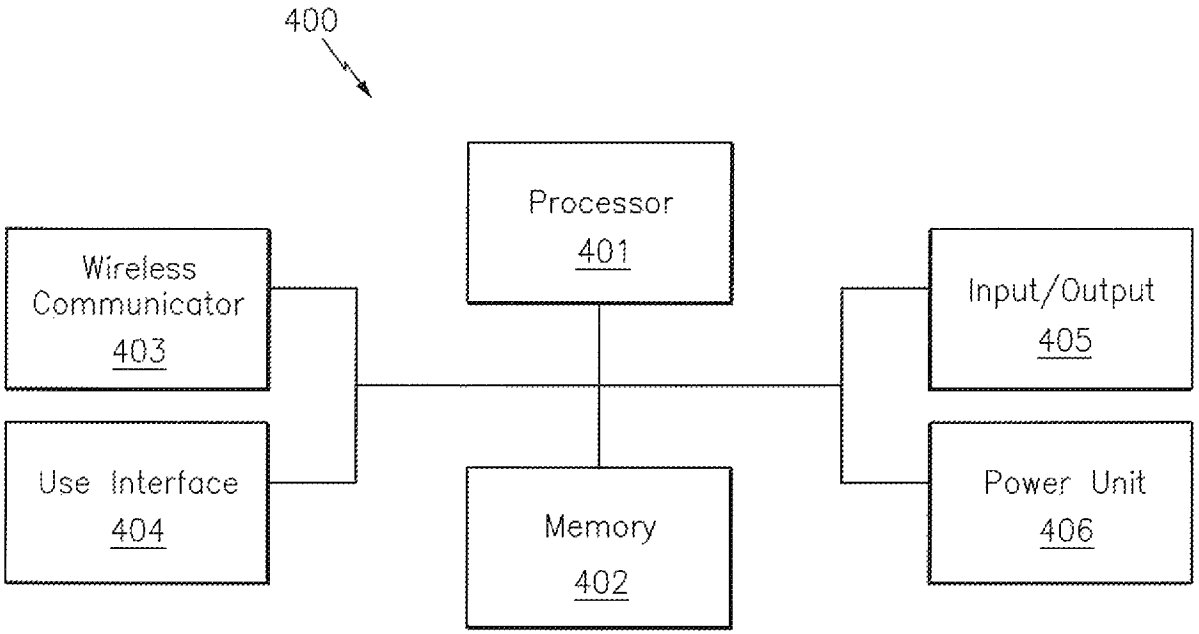
FIG. 4A is a simplified block diagram of the control unit of the bassinet apparatus, in accordance with one embodiment of the invention.

FIG. 4A, illustrates one embodiment of the control unit 400. As shown, the control unit can include a processor 401 that is conventionally connected to an internal memory 402, a wireless communication unit 403, a user interface 404, an input/output unit 405 and a power source 406.

Although illustrated as separate elements, those of skill in the art will recognize that one or more system components may be, or include one or more printed circuit boards (PCB)

containing an integrated circuit or circuits for completing the activities described herein. The CPU may be one or more integrated circuits having firmware for causing the circuitry to complete the activities described herein.

The processor/CPU 401 can act to execute program code stored in the memory 402 in order to allow the device to perform the functionality described herein. Processors are extremely well known in the art, therefore no further description will be provided.

Memory 402 can act to store operating instructions in the form of program code for the processor 401 to execute. In this regard, memory 402 can include one or more physical memory devices such as, for example, local memory and/or one or more bulk storage devices. As used herein, local memory can refer to random access memory or other non-persistent memory device(s) generally used during actual execution of program code, whereas a bulk storage device can be implemented as a persistent data storage device. Additionally, memory 402 can also include one or more cache memories that provide temporary storage of at least some program code in order to reduce the number of times program code must be retrieved from the bulk storage device during execution. Each of these devices are well known in the art.

The wireless communication unit 403 can include any number of devices capable of communicating wirelessly with an external device such as the remote operation unit 50. In one embodiment, the communication unit can include a variable radio wave transmitter and receiver having a unique radio frequency chip capable of transmitting and receiving a plurality of independent radio frequencies, which are stored in the memory 402. Such a feature can allow secure communication between the control unit 400 and the remote operation unit 50.

In another embodiment, the device can also include a Bluetooth transceiver for communicating wirelessly with an external device such as a smartphone, computer and/or tablet device running an App that emulates the operation of the remote operation unit 50. However, any number of other known transmission and reception mechanisms and protocols can also be utilized herein, several nonlimiting examples include infrared (IR), RFID, and/or a network adapter functioning to communicate over a WAN, LAN or the internet via an internet service provided.

The user interface 404 can function to provide direct two-way communication with a device user, in order to allow the same to control the operation of the bassinet. In this regard, the user interface 405 can preferably be secured along the outside portion of the cradle body 31, and can include any number of control inputs such as buttons, switches, dials and the like. The user interface can be in communication with the processor 401 so as to activate different programmatic functions. For example, one button can act to initiate the motion unit to perform a rocking motion, while another button may operate the heating blanket and/or the device speaker. Yet another button can function to switch the electronic components of the device between an ON and OFF state, initiate a Sleep mode, and/or to pair the wireless communication unit with an external device, and so on.

One or more input/output units 405, can be provided in order to allow the control unit to communicate with the device components, such as the motion unit 40, the heating pad 41, and/or the parent interface 42. In the preferred embodiment, the input/output unit(s) can include one or more Universal Serial Bus (USB ports). Of course, any number of other known components are also contemplated.

The power source 406 can function to provide the necessary power requirements to each element of the bassinet apparatus 10. In this regard, the power unit can include any number of step down transformers and/or other components that are capable of engaging a conventional A/C power outlet from a home or building and converting the same into useable device power. Portions of the power unit can preferably be positioned within the main body along the bottom end 11*b*, and can be communicatively linked 47 to the above noted components.

Figure 5:
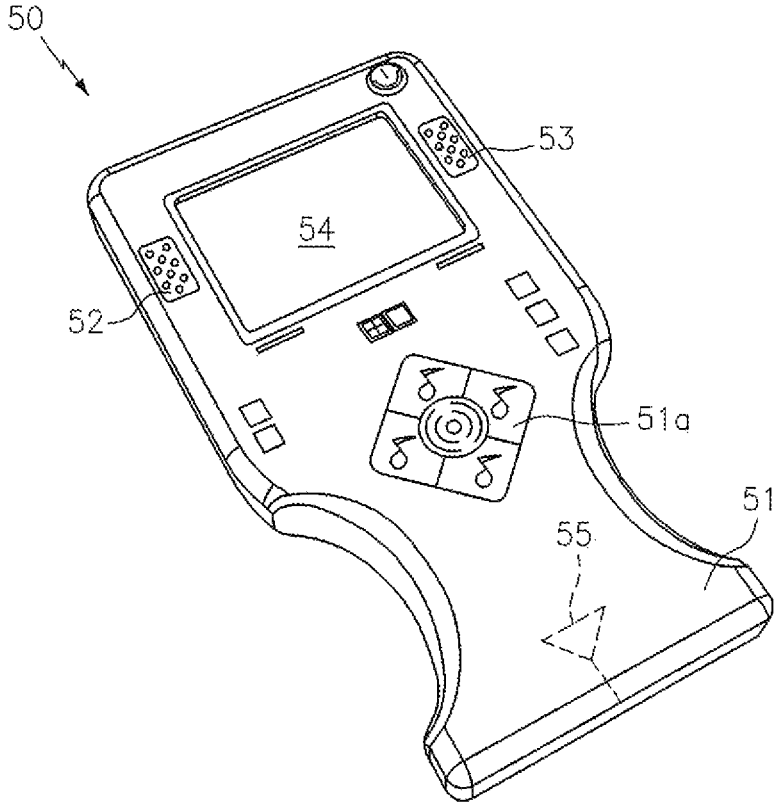
FIG. 5 is a perspective view of the remote operation unit of the bassinet apparatus, in accordance with one embodiment of the invention.

As shown in FIG. 5, the bassinet apparatus 10 can also include a remote operation unit 50. As shown, the unit can include a complementary wireless communication unit 55 having essentially identical components to the above described wireless communication unit 403, in order to allow the two units to communicate effectively. Moreover, the unit 50 can include a main body 51 having a plurality of buttons or other such input means 51*a*, that can provide operating instructions to the bassinet apparatus exactly as described above with respect to the user interface 404. A speaker 52, microphone 53, and display screen 54 can be in communication with the microphone 43, speaker 44 and camera 45, respectively of the parent interface 42, in order to allow a user to watch, listen speak with a child inside the bassinet.

Although described above as including push buttons and other such circuitry, other embodiments are also contemplated. For example, in another embodiment, one or both of the user interface 46 and the remote operation unit 50 can include or consist of a Graphic User Interface (GUI) screen for providing digital communication with a user. To this end, the GUI screen can preferably include a color touch screen monitor for providing a menu of actions that a user can select for instructing the apparatus to perform.

Figure 6:
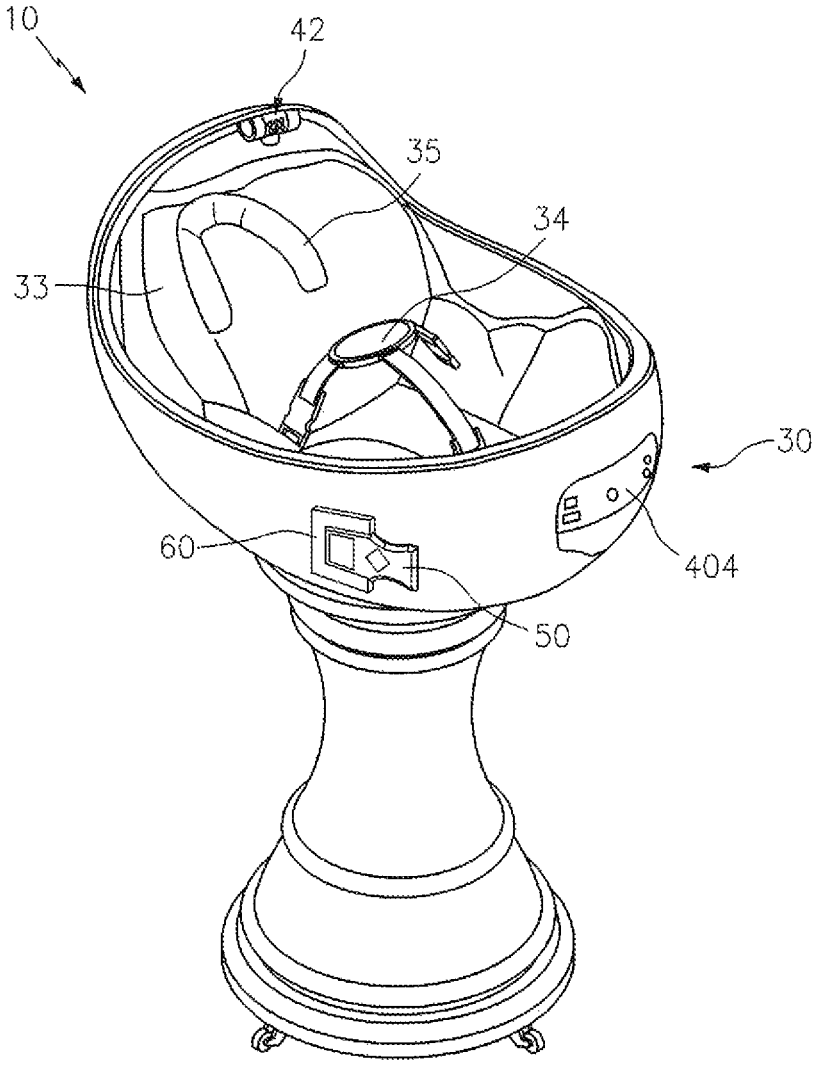
FIG. 6 is another perspective view of the bassinet apparatus, in accordance with one embodiment of the invention.

FIG. 6 is a perspective view illustrating the above described bassinet apparatus in an assembled configuration. As shown, a holster 60 or other such mechanism can be provided along either the cradle 30 or main body 11, in order to receive the remote operation unit 50 when the same is not in operation.

Figure 7:
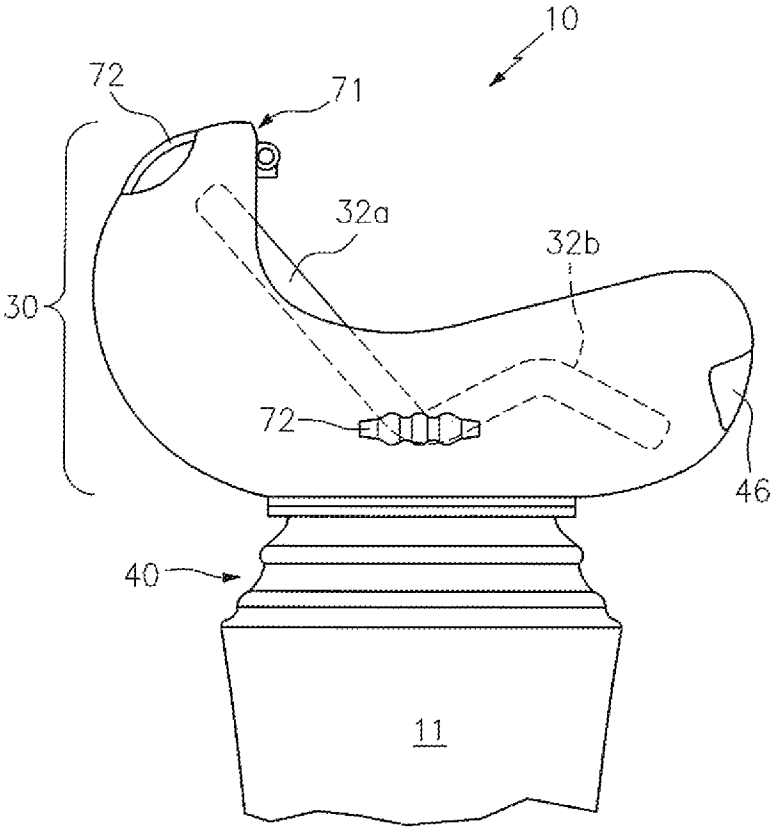
FIG. 7 is a partial perspective view of the bassinet apparatus, in accordance with another embodiment of the invention.

FIG. 7 illustrates an alternate embodiment of the improved bassinet apparatus. As shown, the cradle section 30, can include a more curved/rounded hood section 71 which can extend substantially beyond the back side section of the seat 32*a*. Additionally, one or more handles 72 can be incorporated into the design to facilitate easy movement of the cradle when attached to the main frame 11, or when used in a standalone configuration.

Figure 8:
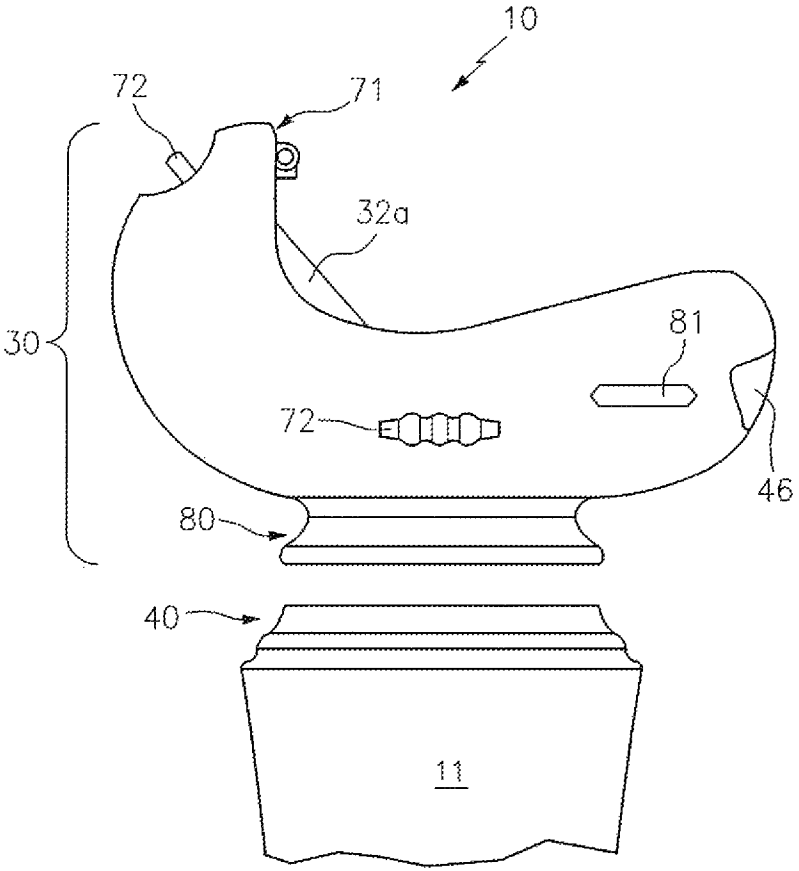
FIG. 8 is another partial perspective view of the bassinet apparatus, in accordance with the another embodiment of the invention.

FIG. 8 further refines the embodiment shown above by providing an intermediate base section 80 which can allow the cradle section 30 to stand upright when not attached to the main body 11. To this end, any number of additional materials such as felt, for example, can also be included to provide a more visually appealing device, and to allowing a softer connection between the cradle and base. Additionally, the device can further include one or more magnetic elements 81 suitable for connecting the remote control unit to the cradle in a removable manner.

As described herein, one or more elements of the bassinet apparatus 10 can be secured together utilizing any number of known attachment means such as, for example, screws, glue, compression fittings and welds, among others. Moreover, although the above embodiments have been described as including separate individual elements, the inventive concepts disclosed herein are not so limiting. To this end, one of skill in the art will recognize that one or more individual elements may be formed together as a continuous element, either through manufacturing processes, such as welding, casting, or molding, or through the use of a singular piece of material milled or machined with the aforementioned components forming identifiable sections thereof.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A bassinet apparatus, comprising:

a main body that comprises a single, rigid and non-uniform pedestal-shaped member having a top end, a bottom end, and a middle section;

a cradle having an exterior surface, an interior surface having a bucket seat configuration, and continuously rounded upper edge that extends along a periphery of each of the exterior and interior surfaces; and a motion unit that is interposed between the top end of the main body and a bottom end of the cradle, said motion unit functioning to position an entirety of the cradle above the main body, and is further configured to impart movement onto the cradle.

2. The apparatus of claim 1, wherein the top and bottom ends of the main body extend radially outward from the middle section to form a generally hourglass shape.

3. The apparatus of claim 1, further comprising:

an elongated hollow interior channel that is disposed along a central vertical axis of the main body, said channel having a first end that is positioned at a center location of the top end of the main body, and a second end that is positioned at a center location of the bottom end of the main body.

4. The apparatus of claim 3, further comprising:

a plurality of connectors that are disposed along the top end of the main body, each of said connectors being disposed equidistantly between the hollow interior channel and an outside surface of the main body.

5. The apparatus of claim 1, wherein the exterior surface of the cradle includes a generally oval shape having no corners or edge sections with an angle greater than 45 degrees.

6. The apparatus of claim 1, wherein the bucket seat includes a bottom section that is secured to each of a reclined back section, and a pair of opposing side sections at angles of 45 degrees or less.

7. The apparatus of claim 6, further comprising:

a waterproof pad;

a three point harness that is in communication with the interior surface;

a pillow headrest; and a heating blanket, wherein said pad and heating blanket are disposed along an entirety of the bucket seat, and the headrest is positioned along an upper portion of the reclined back section.

8. The apparatus of claim 1, wherein the motion unit aligns the cradle with a central vertical axis of the main body, so as to maintain a center of gravity of the apparatus along the central vertical axis.

9. The apparatus of claim 8, wherein the motion unit includes functionality for independently moving the cradle in a front to back direction, and a side to side direction across a linear plane.

10. The apparatus of claim 9, wherein the motion unit includes functionality for independently moving the cradle in a front to back direction, and a side to side direction across an angular plane.

11. The apparatus of claim 1, further comprising:

a parent interface that is permanently secured to the cradle body, said interface including a microphone, a speaker and a camera.

12. The apparatus of claim 11, further comprising:

a control unit that is communicatively linked to a user interface that is secured along the apparatus, said user interface and control units functioning to control an operation of the motion unit and the parent interface unit.

13. The apparatus of claim 12, further comprising:

a remote operation unit that is in wireless communication with the control unit, and functioning to control an operation of the motion unit and the parent interface unit.

14. The apparatus of claim 13, wherein the remote operation unit further includes a speaker, microphone, and display screen that function to communicate wirelessly with the microphone, speaker and camera, respectively of the parent interface.

15. The apparatus of claim 14, further comprising:

a holster for securing the remote operation unit onto the exterior surface of the cradle.

16. The apparatus of claim 1, further comprising:

a plurality of internally located weights that are placed equidistantly along the bottom end of the main body.

17. The apparatus of claim 1, wherein the motion unit further comprises:

an electric motor that independently generates the imparted movement onto the cradle.

18. The apparatus of claim 1, wherein the cradle is removably secured to the main body.

* * * * *